US010808719B2

(12) United States Patent
Conrad et al.

(10) Patent No.: US 10,808,719 B2
(45) Date of Patent: Oct. 20, 2020

(54) BLOWER ARRANGEMENT WITH FLOW DIVIDING NOZZLE

(71) Applicant: ebm-papst Mulfingen GmbH & Co. KG, Mulfingen (DE)

(72) Inventors: Daniel Conrad, Langenbrettach (DE); Björn Sudler, Boxberg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 218 days.

(21) Appl. No.: 15/956,272

(22) Filed: Apr. 18, 2018

(65) Prior Publication Data

US 2018/0335048 A1 Nov. 22, 2018

(30) Foreign Application Priority Data

May 16, 2017 (DE) ..... 10 2017 110 642

(51) Int. Cl.
*F04D 29/44* (2006.01)
*F04D 29/42* (2006.01)
(Continued)

(52) U.S. Cl.
CPC ..... *F04D 29/441* (2013.01); *F04D 29/16* (2013.01); *F04D 29/162* (2013.01); *F04D 29/42* (2013.01);
(Continued)

(58) Field of Classification Search
CPC .... F04D 29/441; F04D 29/68; F04D 29/4226; F04D 29/16; F04D 29/44; F04D 29/681;
(Continued)

(56) References Cited

U.S. PATENT DOCUMENTS 5,478,201 A * 12/1995 Amr ..... F04D 17/16 415/119
5,525,036 A * 6/1996 Park ..... F04D 29/4213 415/208.1
(Continued)

FOREIGN PATENT DOCUMENTS

AT 241 674 B 8/1965
DE 10 2016 103 135 A1 8/2016

OTHER PUBLICATIONS

German International Search Report for DE 10 2017 110 842.1, dated Jan. 25, 2018.

*Primary Examiner* — Kenneth Bomberg
*Assistant Examiner* — Adam W Brown
(74) *Attorney, Agent, or Firm* — Dickinson Wright PLLC

(57) ABSTRACT

A blower arrangement comprising an impeller, which has an axial intake opening formed by a cover plate covering impeller blades at least in sections, by an intake nozzle connected upstream of the impeller, which extends at least in sections into an overlap section in the intake opening of the impeller, wherein a circumferential nozzle gap is formed between the intake nozzle and the cover plate of the impeller, an outer nozzle, which is arranged spaced apart in the radial direction in relation to the impeller and the intake nozzle and enclosing them in the circumferential direction. A first circumferential radial gap is provided between the outer nozzle and the intake nozzle, which forms an inlet nozzle duct extending in the flow direction. A second circumferential radial gap is provided between the outer nozzle and the cover plate of the impeller, which forms a gap duct extending in the flow direction.

20 Claims, 4 Drawing Sheets

(51) Int. Cl.
*F04D 29/16* (2006.01)
*F04D 29/68* (2006.01)

(52) U.S. Cl.
CPC ..... *F04D 29/4213* (2013.01); *F04D 29/4226* (2013.01); *F04D 29/44* (2013.01); *F04D 29/68* (2013.01); *F04D 29/681* (2013.01); *F05D 2240/128* (2013.01)

(58) Field of Classification Search
CPC .... F04D 29/162; F04D 29/42; F04D 29/4213; F05D 2240/128
See application file for complete search history.

(56) References Cited

U.S. PATENT DOCUMENTS 5,551,838 A * 9/1996 Hugbart ..... F04D 29/4213 415/206
5,667,360 A * 9/1997 Hauser ..... F04D 29/023 416/183
6,164,909 A * 12/2000 Ehlers ..... F04D 29/281 165/140
7,229,243 B2 * 6/2007 Nikpour ..... F04D 29/4213 415/144
10,094,391 B2 * 10/2018 Miyoshi ..... F04D 29/441
2016/0245304 A1 8/2016 Miyoshi et al.

* cited by examiner

BLOWER ARRANGEMENT WITH FLOW DIVIDING NOZZLE

RELATED APPLICATIONS

This application claims the benefit of and priority to German Patent Application No. 10 2017 110 642.1, filed on May 16, 2017, the entire contents of each of which are incorporated herein by reference.

FIELD

The present disclosure relates to a blower arrangement comprising an impeller, an intake nozzle connected upstream of the impeller in the flow direction, and an outer nozzle, which is arranged spaced apart in the radial direction in relation to the impeller and the intake nozzle and enclosing them in the circumferential direction.

BACKGROUND

The fundamental technical object of a nozzle arrangement on a blower is to supply the fluid to be conveyed as free of loss as possible. A differentiation is made between the main volume flow and the recirculation volume flow in this case. The main volume flow represents the actually conveyed volume flow and is conveyed from the intake side through the impeller to the pressure side. The recirculation volume flow is a backflow, which, coming from the pressure side, enters the impeller of the blower again on the suction side through the gap between impeller and nozzle. This corresponds to a pulse flow through the gap tween impeller and nozzle, which is advantageous for deflecting the flow in the region of the cover plate. However, it is disadvantageous at the same time that this recirculation volume flow represents a volumetric loss.

The statements in this section merely provide background information related to the present disclosure and may not constitute prior art.

BRIEF SUMMARY

The present disclosure therefore provides a blower arrangement comprising a nozzle, which uses the advantages of the pulse flow between impeller and nozzle without having to accept a volumetric loss due to a recirculation volume flow. In this case, the main volume flow is still to be supplied to the impeller of the fan as free of loss as possible.

According to the present disclosure, a blower arrangement is proposed for this purpose, comprising an impeller having an axial intake opening, which is formed by a cover plate covering impeller blades at least in sections, an intake nozzle connected upstream of the impeller in the flow direction, which extends into the intake opening of the impeller at least in sections in an overlap section, wherein a circumferential nozzle gap is formed between the intake nozzle and the cover plate of the impeller, and an outer nozzle, which is arranged spaced apart from the impeller and the intake nozzle in the radial direction and enclosing them in the circumferential direction. A circumferential radial gap, which forms an inlet nozzle duct extending in the flow direction, is provided between the outer nozzle and the intake nozzle. A circumferential radial gap, which forms a gap duct extending in the flow direction, is also formed between the outer nozzle and the cover plate of the impeller, such that a total volume flow suctioned in by the impeller can be divided by the intake nozzle and the outer nozzle into a main volume flow flowing through the intake nozzle into the impeller and a secondary volume flow flowing through the inlet nozzle duct, and the secondary volume flow can subsequently be divided by the cover plate of the impeller and the outer nozzle into a gap volume flow flowing through the gap duct and an auxiliary volume flow flowing into the nozzle gap to the main volume flow. The intake nozzle therefore offers a twofold division both in the intake region and also in the overlap region with the impeller and thus functions as a flow division nozzle.

The blower arrangement according to the present disclosure causes an efficiency increase in impellers, in particular in radial impellers, because of the avoidance or reduction of the recirculation volume flow while simultaneously maintaining the advantageous pulse flow in the nozzle gap between impeller and intake nozzle.

In the blower arrangement, it is provided that the total volume flow is formed from the total of the main volume flow flowing from the intake nozzle and the outer nozzle through the intake nozzle into the impeller and the secondary volume flow flowing through the intake nozzle duct.

The secondary volume flow is in turn formed from the total of the gap volume flow flowing through the gap duct and the auxiliary volume flow flowing in the nozzle gap to the main volume flow.

One advantageous embodiment variant of the blower arrangement provides that the intake nozzle extends in the axial direction beyond an intake-side axial end of the outer nozzle and curved radially outward in its free axial end section, so that an inlet opening facing radially outward is formed between the intake nozzle and the outer nozzle. The intake between the outer nozzle and the intake nozzle into the inlet nozzle duct therefore does not occur in the axial direction but rather in the radial direction, while in contrast the main flow through the entire intake nozzle extends primarily in the axial direction.

Interaction between intake nozzle and impeller, in particular radial impeller, involves in one embodiment variant that the free end section of the intake nozzle, which extends into the intake opening of the impeller, extends radially outward toward the cover plate of the impeller, so that in the overlap section between intake nozzle and impeller, a radial nozzle gap dimension of the nozzle gap decreases viewed in the axial flow direction. The flow is thus guided in the nozzle gap toward the cover plate of the impeller.

An embodiment that is advantageous in this case in which the cover plate extends parallel to the rotational axis of the impeller at its axial section adjoining the intake opening. The course in the overlap section is thus also parallel to the rotational axis of the impeller. In the further axial course, the flow cross section of the impeller increases along the cover plate in the flow direction, wherein the cover plate accordingly widens in the radial direction.

Furthermore, an embodiment of the blower arrangement is fluidically advantageous in which a gap duct dimension spK of the gap duct between the outer nozzle and the cover plate of the impeller is substantially constant in the axial flow direction. The geometrical courses of outer nozzle and cover plate are therefore identical or substantially identical.

Moreover, it is fluidically advantageous if the inlet nozzle duct dimension spN of the inlet nozzle gap duct is constant or substantially constant in the axial flow direction from the inlet opening up to the cover plate of the impeller.

In a refinement of the blower arrangement, the outer nozzle has a flow guiding geometry extended beyond the impeller on the pressure side, which geometry extends in the radial direction beyond an exhaust opening of the impeller adjoining the cover plate of the impeller and is formed to guide flow exhausted from the impeller in a predetermined direction. Alternatively or additionally, in one embodiment of blower arrangement, the outer nozzle can have a flow guiding geometry extended beyond the impeller on the pressure side, which geometry spans an exhaust opening of the impeller adjoining the cover plate of the impeller in the axial direction and is formed to guide flow exhausted from the impeller in a predetermined direction. The flow guiding geometry can also be used in this case for the purpose of deflecting the flow direction. In the case of a radial impeller, for example, from a radial direction into an axial direction. In the case of a use of the blower arrangement, for example, in a tube or in a box, wherein an axial flow is to be achieved, this results in a substantial efficiency increase. Moreover, auxiliary parts for aligning the flow are obsolete.

In another exemplary embodiment of the blower arrangement, gap blades protruding in the direction of the outer nozzle are provided on the cover plate of the impeller. It is advantageous in this case that the gap blades ensure an improvement of the efficiency, by working in operation of the impeller against the pressure difference of pressure side and suction side of the blower arrangement or of a region of the intake nozzle and an exhaust section on the impeller.

The gap blades are formed in advantageous exemplary embodiments as linear radial blades or blades curved forward or backward. The vertical extension thereof in the gap duct is in a range of 40-60% of the maximum height of the gap duct minus the manufacturing tolerance.

Furthermore, it is advantageous if the gap blades are arranged spaced apart in relation to the intake opening of the impeller in the axial flow direction. The preferred extension thereof in the flow direction corresponds to 40-90%, in particular 40-70% of the axial projection length of the cover plate of the impeller. Moreover, the gap blades are arranged distributed at uniform intervals over the entire circumference of the cover plate. The number of the gap blades is, in one advantageous embodiment, greater than 12, more preferably greater than 16, still more preferably greater than 20.

With respect to the geometry of the outer nozzle, the flow cross section thereof, decreases in the flow direction from an initial cross section to a minimal cross section and subsequently increases to a final cross section. The nozzle gap is preferably arranged between the intake nozzle and the cover plate of the impeller in a region of the minimal cross section, in which the pressure is minimal and the flow speed is maximal.

To achieve a high efficiency, in the blower arrangement, the ratio between the nozzle gap dimension spD of the nozzle gap and the impeller external diameter DA of the impeller is fixed as small as possible and is in a range from 0.003 to 0.007 or at 0.005.

Furthermore, in a fluidically advantageous embodiment variant of the blower arrangement, the intake opening gap dimension spN is greater than the gap duct dimension spK of the gap duct and greater than the nozzle gap dimension spD of the nozzle gap. However, ten times the value is not to be exceeded, so that $spN \leq 10*spK$, spD applies.

An embodiment is also fluidically advantageous in which the through-flow cross section DH of the intake nozzle decreases in the flow direction from a maximal intake through-flow cross section DHmax to a minimal through-flow cross section DHmin, wherein a ratio of the minimal and maximal intake through-flow cross sections DHmin, DHmax to an impeller external diameter DA of the impeller is in a range such that $DHmin/DA<DHmax/DA<1$ applies. Moreover, an advantageous ratio of the minimal intake through-flow cross section DHmin to the impeller external diameter DA of the impeller is in a range such that $0.3<DHmin/DA<0.9$ applies.

Other advantageous refinements of the present disclosure are characterized in the dependent claims and/or are described in greater detail hereafter together with the description of the preferred embodiment of the present disclosure on the basis of the figures. All disclosed features can be combined arbitrarily if this is technically possible and not contradictory. Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In the figures.

Identical reference signs indicate identical parts in all views. The drawings described herein are for illustration purposes only and are not intended to limit the scope of the present disclosure in any way.

DETAILED DESCRIPTION

Figure 1:
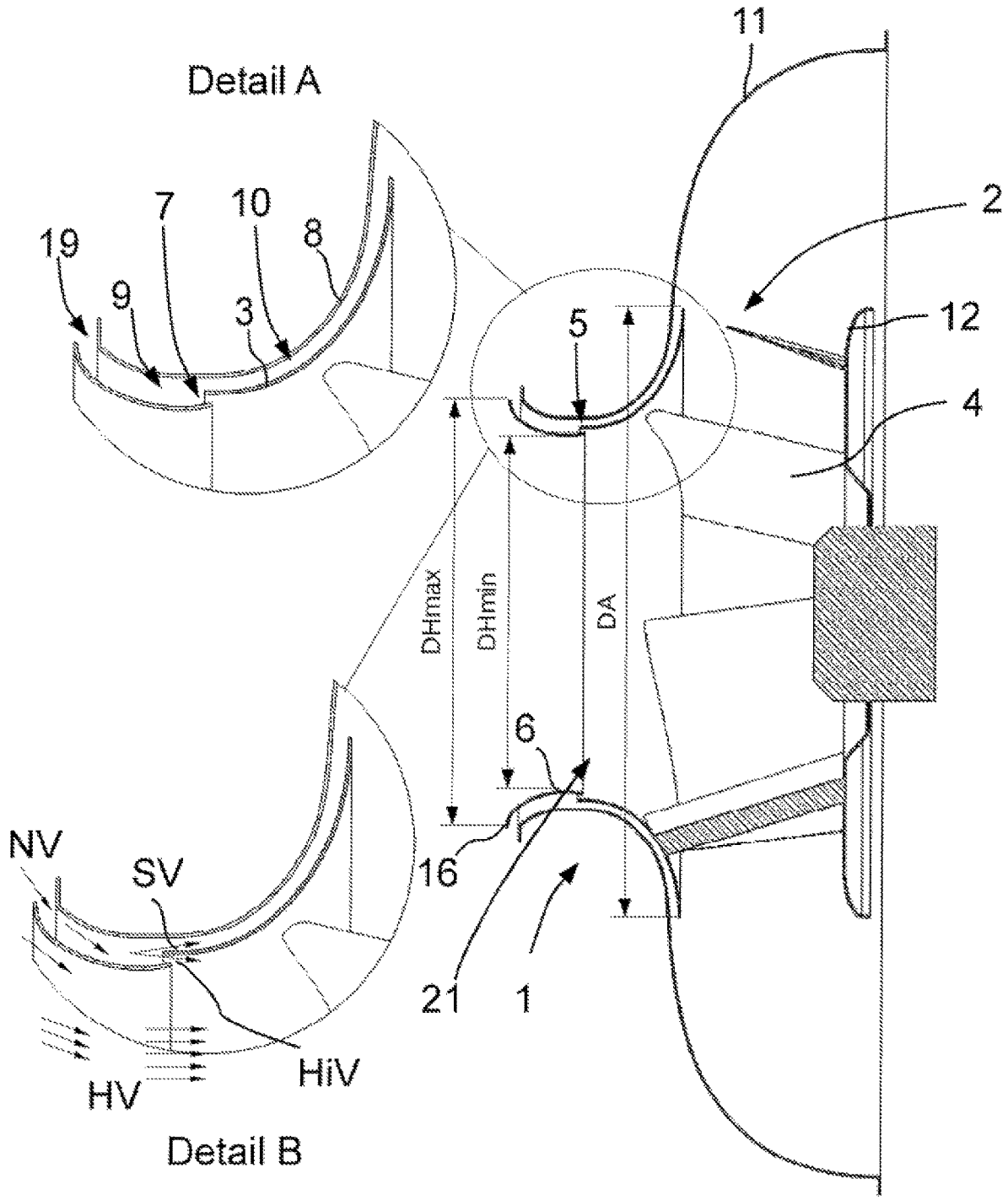
FIG. 1 shows a lateral sectional view of a blower arrangement in a first exemplary embodiment with detail views A and B.

The following description is merely exemplary in nature and is not intended to limit the present disclosure, application, or uses. It should be understood that throughout the drawings, corresponding reference numerals indicate like or corresponding parts and features.

Figure 2:
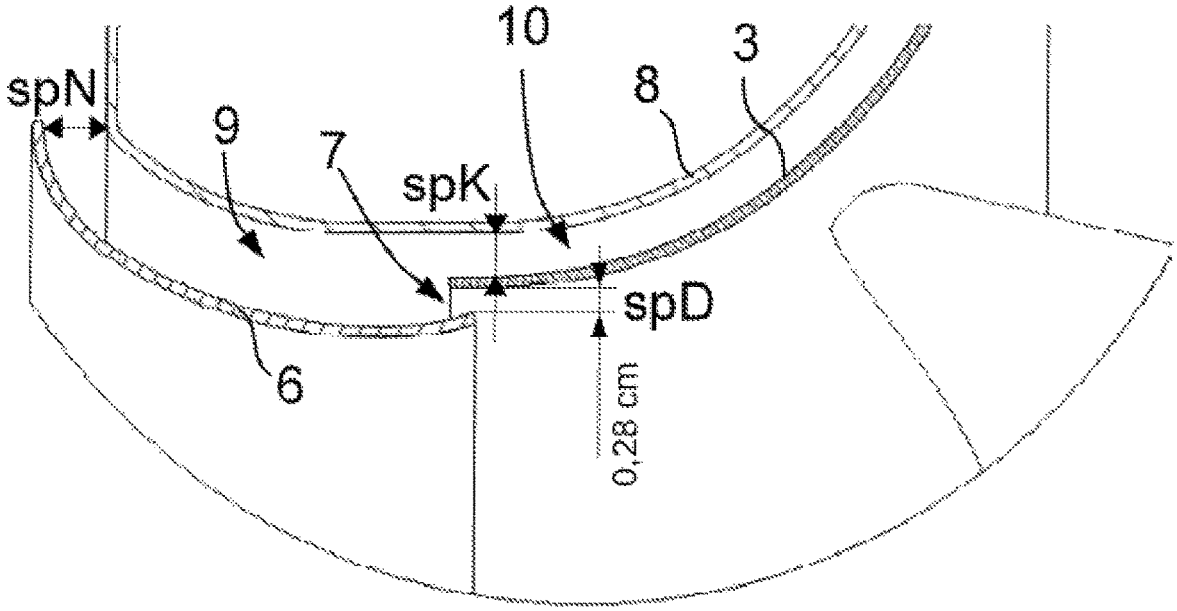
FIG. 2 shows an enlarged view of detail views A, B from FIG. 1.

FIGS. 1 and 2 show a lateral sectional view of a blower arrangement 1 in a first exemplary embodiment with detail views A and B and an enlarged view (FIG. 2) of the detail. The blower arrangement 1 comprises a (radial) impeller 2, formed from a planar bottom plate 12, a funnel-shaped cover plate 3, and a blade ring, which is formed from multiple impeller blades 4, arranged in between. The cover plate 3 of the impeller 2 covers the impeller blades 4 and has an axial intake opening 21 and a radial exhaust section. Connected upstream of the impeller 2 in the flow direction, the blower arrangement 1 comprises an intake nozzle 6, which extends in sections into the intake opening 21 of the impeller 2 in the overlap section 5. The external diameter of the intake nozzle 6 is smaller in the overlap section 5 than that of the intake opening 21 of the impeller 2, so that a circumferential nozzle gap 7 is formed between the intake nozzle 6 and the cover plate 3 of the impeller 2. The impeller 2 and the intake nozzle 6 are enclosed on the radial outside by an outer nozzle 8 in the circumferential direction, wherein a circumferential radial gap is formed between the outer nozzle 8 and the intake nozzle 6, which gap forms the inlet nozzle duct 9 extending in the flow direction, and a circumferential radial gap is provided between the outer nozzle 8 and the cover plate 3 of the impeller 2, which gap forms the gap duct 10 extending in the flow direction.

The intake nozzle 6 protrudes in the axial direction beyond the intake-side axial end of the outer nozzle 8 and extends in its free axial end section 16 curved radially outward, such that an inlet opening 19 facing radially outward is formed between the intake nozzle 6 and the outer nozzle 8. The geometrical shape of the outer nozzle 8 and the intake nozzle 6 is identical in the region of the inlet opening 19, such that both elements extend parallel to one another and form the inlet nozzle duct 9 having a substantially constant gap dimension spN.

The free end section of the intake nozzle 6 extending into the intake opening 21 of the impeller 2 is formed such that it extends radially outward on the cover plate 3 of the impeller 2, such that the radial nozzle gap dimension spD of the nozzle gap 7 decreases viewed in the axial flow direction in the overlap section 5 between intake nozzle 6 and impeller 2. Moreover, the flow is guided toward the inner wall of the cover plate 3. The geometric shape is implemented by a rounding of the intake nozzle 6 and an axial section of the cover plate 3 which extends parallel to the rotational axis of the impeller 2 and adjoins the intake opening 21.

The inlet duct 9 ends at the axial end of the cover plate 3, i.e., the intake opening 21. The cover plate 3 divides the intake duct 9 essentially in the middle into a gap duct 10 adjoining in the flow direction between the cover plate 3 of the impeller 2 and the outer nozzle 8, which has an essentially constant gap dimension spK. This is achieved by a substantially identical geometric shape of the outer nozzle 8 and the cover plate 3 in the region of the cover plate 3. The outer nozzle 8 has, on the pressure side, a flow guiding geometry 11 extended beyond the impeller 2, which geometry extends in the radial and axial directions beyond the exhaust opening of the impeller 2 adjoining the cover plate 3 of the impeller 2 and guides the flow exhausted by the impeller 2 in the axial direction. The outer nozzle 8 is shaped such that it's through-flow cross section, viewed in the flow direction, decreases from an initial cross section to a minimal cross section and subsequently initially increases up to the region of the cover plate 3 and beyond into the region of the flow guiding geometry 11. The nozzle gap 7 between the intake nozzle 6 and the cover plate 3 of the impeller 2 is arranged in the region of the minimal cross section, i.e., in the region of the maximal partial vacuum.

In the blower arrangement 1, the total volume flow generated via the impeller 2 is divided on the intake side by the intake nozzle 6 and the outer nozzle 8 into the main volume flow HV flowing through the intake nozzle 6 into the intake opening 21 of the impeller 2 and the secondary volume flow NV flowing through the inlet nozzle duct 9. The secondary volume flow NV is subsequently divided by the cover plate 3 of the impeller 2 and the outer nozzle 8 into the gap volume flow SV flowing through the gap duct 10 and the auxiliary volume flow HiV flowing into the nozzle gap 7 as a pulse flow to the main volume flow HV. All flows are reunified in the radial exhaust section of the impeller 2.

Figure 3:
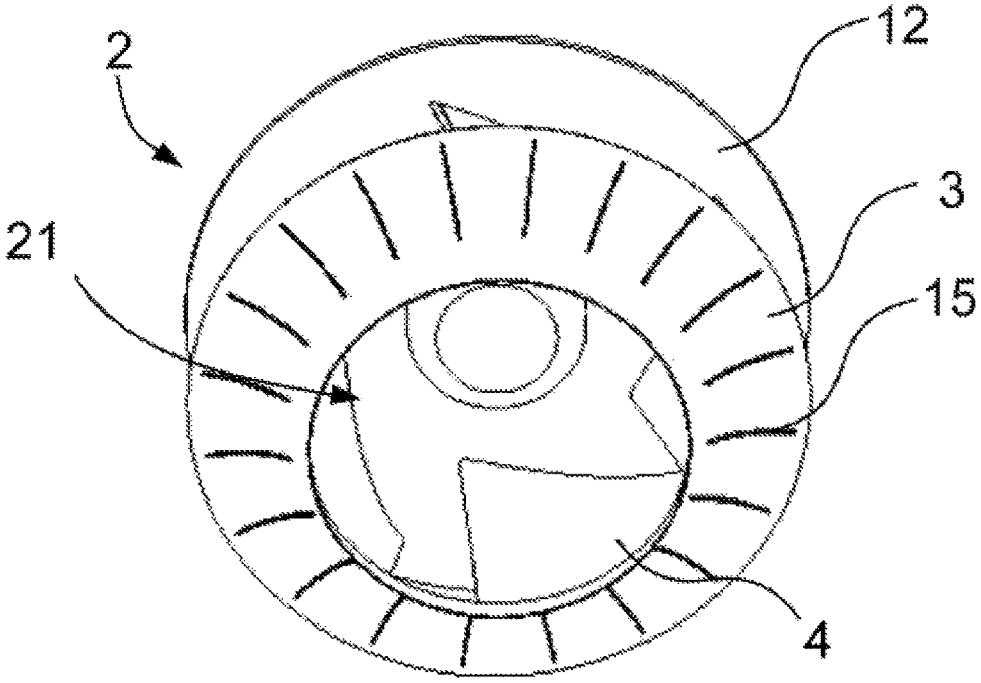
FIG. 3 shows a perspective view of an impeller in an alternative embodiment.

In FIG. 3, an impeller 2, which is usable for the embodiment according to FIG. 1 and is designed as a radial impeller, is illustrated in a perspective view. In the embodiment according to FIG. 3, however, in contrast to the embodiment according to FIG. 1, a plurality of gap blades 15 formed as radial blades is arranged on the cover plate 3. The gap blades 15 are distributed uniformly in the circumferential direction over the cover plate 3 and extend spaced apart toward and between the edge sections of the intake opening 21 and the exhaust section between bottom plate 12 and cover plate 3.

Figure 4:
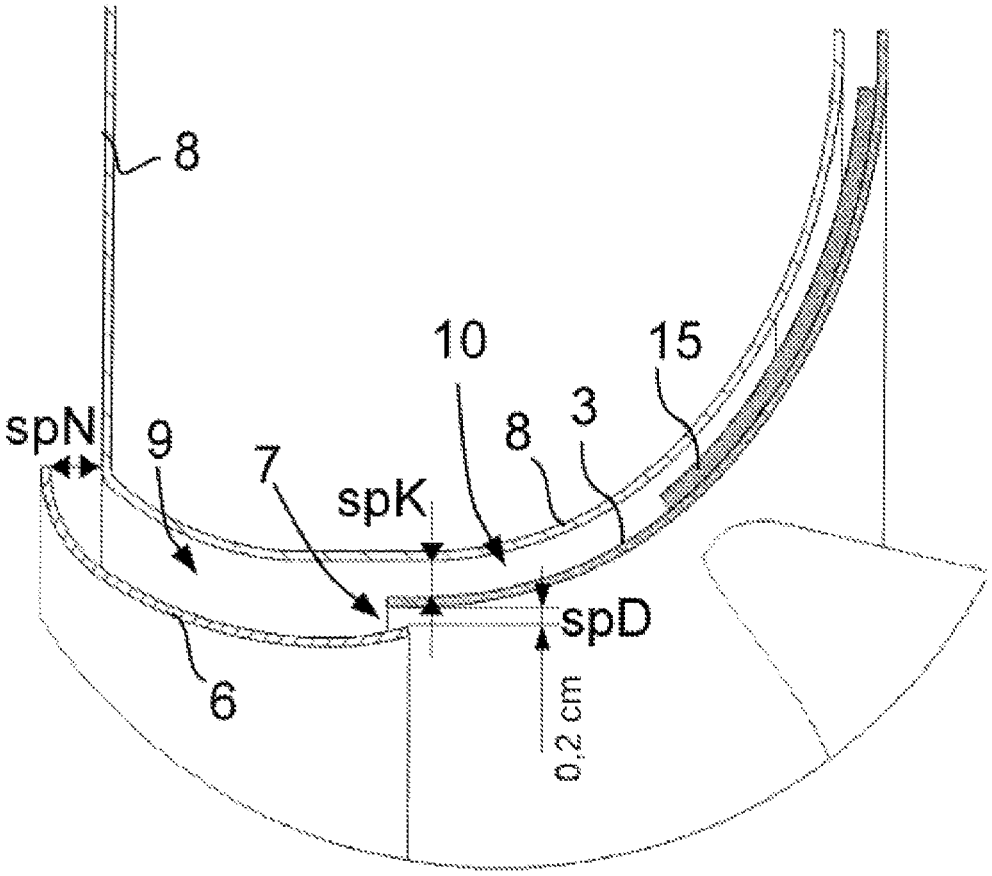
FIG. 4 shows a lateral sectional view of a blower arrangement in a further exemplary embodiment.

An alternative embodiment of the blower arrangement 1 from FIGS. 1 and 2 is illustrated in FIG. 4. To avoid repetitions, the above disclosure on FIGS. 1 and 2 also applies to FIG. 4. In contrast to the embodiment according to FIG. 1, the impeller 2 shown in FIG. 3 is used with gap blades 15 which protrude into the gap duct 10 in the direction of the outer nozzle 8. The radial extension of the gap blades 15 corresponds to 50% of the gap dimension spK of the gap duct 10. Moreover, an alternative outer nozzle 8 is used, which extends linearly on the intake side in the radial direction and is formed without flow guiding geometry on the pressure side.

For all disclosed exemplary embodiments, the intake opening gap dimension spN is greater than the gap duct dimension spK of the gap duct 10 and is greater than the nozzle gap dimension spD of the nozzle gap 7. In the embodiments according to FIG. 2 and FIG. 4, spN=1.5*spK and spN=2.5*spD apply.

Furthermore, the ratios of the minimal and maximal intake through-flow cross sections DHmin, DHmax to the maximal impeller outer diameter DA of the impeller 2 are fixed at $0.3<DHmin/DA<0.9$ and $DHmin/DA<DHmax/DA\leq 1$.

The ratio between the nozzle gap dimension spD of the nozzle gap 7 and the impeller external diameter DA is 0.005.

Figure 5:
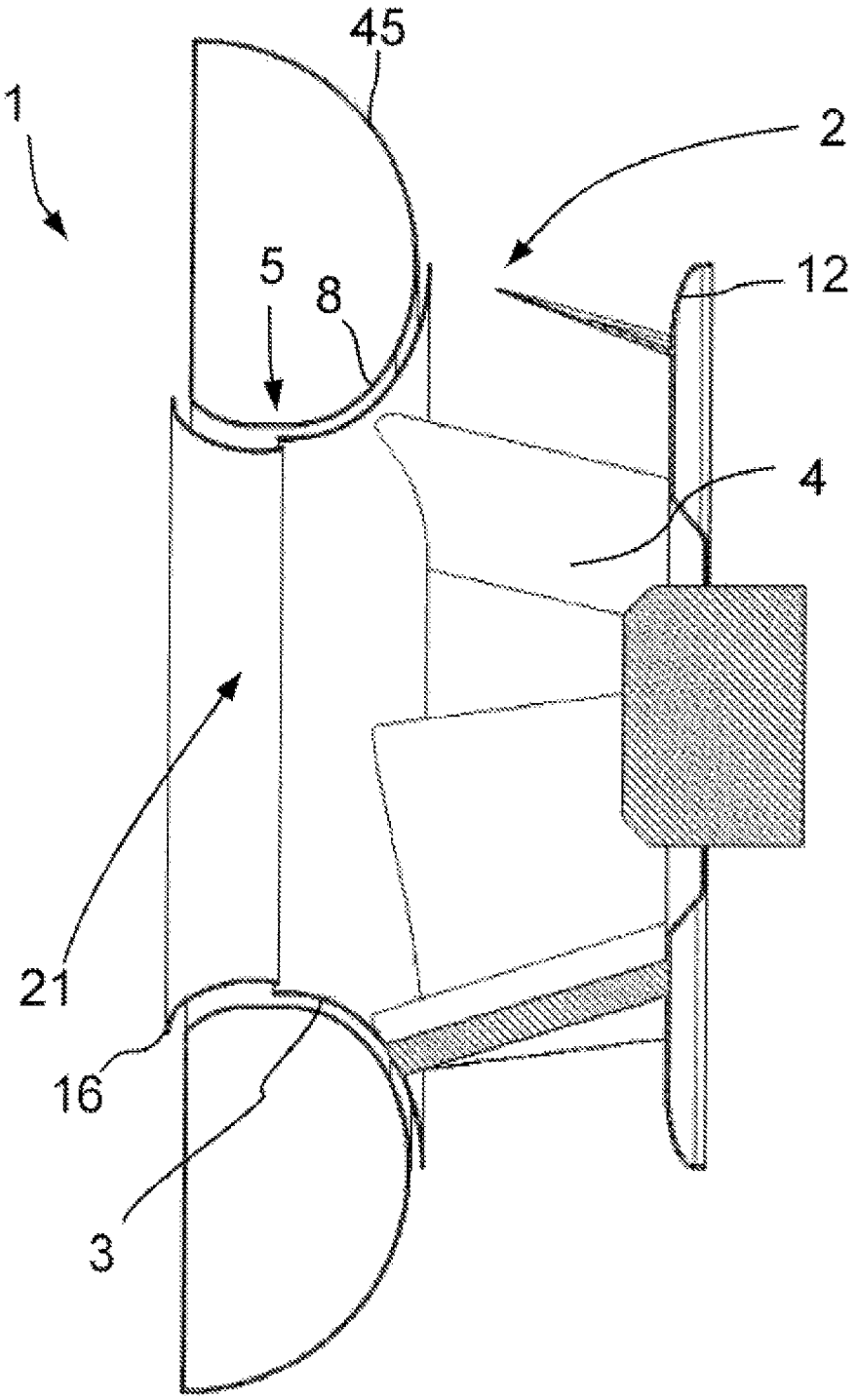
FIG. 5 shows a lateral sectional view of the blower arrangement in a further exemplary embodiment.

A lateral sectional view of the blower arrangement 1 is illustrated in an exemplary embodiment in FIG. 5, in which the outer nozzle 8 forms a diffuser 45. Otherwise, the features of the previous exemplary embodiment also apply in their entirety to the exemplary embodiment according to FIG. 5. The diffuser 45 forms an extension of the nozzle contour at the impeller exit of the impeller 2 to reduce the Carnot losses. The nozzle contour is formed corresponding to the contour of the cover plate 3 of the impeller 3, such that the gap duct 10 has a substantially constant through-flow cross-sectional area. Gap blades 15 can also be used in this embodiment, as described above.

The description of the disclosure is merely exemplary in nature and, thus, variations that do not depart from the substance of the disclosure are intended to be within the scope of the disclosure. Such variations are not to be regarded as a departure from the spirit and scope of the disclosure.

The invention claimed is:

1. A blower arrangement comprising:

an impeller, which has an axial intake opening, and which is formed by a cover plate that covers impeller blades at least in sections;

an intake nozzle located upstream of the impeller in the flow direction, which extends into the intake opening of the impeller at least in sections in an overlap section, wherein a circumferential nozzle gap is formed between the intake nozzle and the cover plate of the impeller; and an outer nozzle which is arranged spaced apart in relation to the impeller and the intake nozzle in the radial direction and enclosing the impeller and intake nozzle in the circumferential direction, wherein a first circumferential radial gap is provided between the outer nozzle and the intake nozzle, wherein the first gap forms an intake nozzle duct extending in the flow direction, and wherein a second circumferential radial gap is provided between the outer nozzle and the cover plate of the impeller, wherein the second circumferential gap forms a gap duct extending in the flow direction, wherein a total volume flow suctioned in by the impeller is divided by the intake nozzle and the outer nozzle into a main volume flow flowing through the intake nozzle into the impeller and a secondary volume flow flowing through the intake nozzle duct, and wherein the secondary volume flow is subsequently divided by the cover plate of the impeller and the outer nozzle into a gap volume flow flowing through the gap duct and an auxiliary volume flow flowing into the nozzle gap to the main volume flow.

2. The blower arrangement as claimed in claim 1, wherein the intake nozzle extends in the axial direction beyond an intake-side axial end of the outer nozzle and curved radially outward in its free axial end section, wherein an inlet opening facing radially outward is formed between the intake nozzle and the outer nozzle.

3. The blower arrangement as claimed in claim 1, wherein a free end section of the intake nozzle, which extends into the intake opening of the impeller, extends radially outward on the cover plate of the impeller, wherein a radial nozzle gap dimension spD of the nozzle gap decreases as viewed in the axial flow direction in the overlap section between intake nozzle and impeller.

4. The blower arrangement as claimed in claim 1, wherein the cover plate extends parallel to the rotational axis of the impeller at its axial section adjoining the intake opening.

5. The blower arrangement as claimed in claim 1, wherein a gap duct dimension spK of the gap duct is constant in the axial flow direction.

6. The blower arrangement as claimed in claim 1, wherein an inlet nozzle duct gap dimension spN of the inlet nozzle gap duct is constant in the axial flow direction from the inlet opening up to the cover plate of the impeller.

7. The blower arrangement as claimed in claim 1, wherein the outer nozzle has a flow guiding geometry extended beyond the impeller on the pressure side, which geometry extends in the radial direction beyond an exhaust opening of the impeller adjoining the cover plate of the impeller and is shaped to guide the flow exhausted by the impeller.

8. The blower arrangement as claimed in claim 1, wherein the outer nozzle has a flow guiding geometry extended beyond the impeller on the pressure side, which geometry spans an exhaust opening of the impeller adjoining the cover plate of the impeller in the axial direction and is designed to guide the flow exhausted by the impeller.

9. The blower arrangement as claimed in claim 1, wherein gap blades protruding in the direction of the outer nozzle are provided on the cover plate of the impeller.

10. The blower arrangement as claimed in claim 9, wherein the gap blades are designed as linear radial blades or as blades curved to the rear.

11. The blower arrangement as claimed in claim 9, wherein the gap blades are arranged spaced apart in the axial flow direction in relation to the intake opening of the impeller.

12. The blower arrangement as claimed in claim 1, wherein a through-flow cross section of the outer nozzle, viewed in the flow direction, decreases from an initial cross section to a minimal cross section and subsequently increases to a final cross section, wherein the nozzle gap is arranged between the intake nozzle and the cover plate of the impeller in a region of the minimal cross section.

13. The blower arrangement as claimed in claim 3, wherein a ratio spD/DA between the nozzle gap dimension spD of the nozzle gap and an impeller external diameter DA of the impeller is in a range from 0.003 to 0.003 or is 0.005.

14. The blower arrangement as claimed in claim 6, wherein the intake opening gap dimension spN is greater than the gap duct dimension spK of the gap duct and is greater than the nozzle gap dimension spD of the nozzle gap, wherein spN:s; 10*spK.

15. The blower arrangement as claimed in claim 1, wherein a through-flow cross section DH of the intake nozzle decreases in the flow direction from a maximal intake through-flow cross section DHmax to a minimal through-flow cross section DHmin, wherein a ratio of the minimal and maximal intake through-flow cross sections DHmin, DHmax to an impeller external diameter DA of the impeller is in a range in which DHmin/DA<DHmax/DA<1 applies.

16. The blower arrangement as claimed in claim 1, wherein a through-flow cross section DH of the intake nozzle decreases in the flow direction from a maximal intake through-flow cross section DHmax to a minimal through-flow cross section DHmin, wherein a ratio of the minimal intake through-flow cross section DHmin to an impeller external diameter DA of the impeller is in a range in which 0.3<DHmin/DA<0.9 applies.

17. The blower arrangement as claimed in claim 1, wherein a through-flow cross section of the impeller increases along the cover plate in the flow direction.

18. The blower arrangement as claimed in claim 1, wherein the total volume flow is formed from the total of the main volume flow flowing from the intake nozzle and the outer nozzle into the impeller through the intake nozzle and the secondary volume flow flowing through the inlet nozzle duct.

19. The blower arrangement as claimed in claim 1, wherein the secondary volume flow is formed from the total of the gap volume flow flowing through the gap duct and the auxiliary volume flow flowing into the nozzle gap to the main volume flow.

20. The blower arrangement as claimed in claim 1, wherein the outer nozzle forms a diffuser extended on the pressure side beyond the impeller.

* * * * *